US008789828B2

(12) United States Patent
Wang et al.

(10) Patent No.: US 8,789,828 B2
(45) Date of Patent: Jul. 29, 2014

(54) BANKNOTE INCLINATION CORRECTION DEVICE AND ATM

(75) Inventors: Peng Wang, Guangzhou (CN); Dongbo Liu, Guangzhou (CN)

(73) Assignee: GRG Banking Equipment Co., Ltd., Guangzhou (CN)

( * ) Notice: Subject to any disclaimer, the term of this patent is extended or adjusted under 35 U.S.C. 154(b) by 0 days.

(21) Appl. No.: 13/882,989

(22) PCT Filed: Jul. 4, 2012

(86) PCT No.: PCT/CN2012/078165

§ 371 (c)(1),
(2), (4) Date: May 2, 2013

(87) PCT Pub. No.: WO2013/040931

PCT Pub. Date: Mar. 28, 2013

(65) Prior Publication Data

US 2014/0183816 A1 Jul. 3, 2014

(30) Foreign Application Priority Data

Sep. 23, 2011 (CN) ..... 2011 1 0288382

(51) Int. Cl.
*B65H 9/16* (2006.01)
*B65H 9/04* (2006.01)
*B65H 9/10* (2006.01)

(52) U.S. Cl.
CPC ..... *B65H 9/04* (2013.01); *B65H 9/106* (2013.01); *B65H 9/16* (2013.01); *B65H 9/166* (2013.01)
USPC ..... 271/251

(58) Field of Classification Search
CPC ..... B65H 9/00; B65H 9/04; B65H 9/10; B65H 9/106; B65H 9/16; B65H 9/166
USPC ..... 271/250, 251, 252
See application file for complete search history.

(56) References Cited

U.S. PATENT DOCUMENTS 3,595,565 A * 7/1971 Bergland ..... 271/251
4,809,968 A * 3/1989 Malachowski ..... 271/251

(Continued)

FOREIGN PATENT DOCUMENTS

CN 1184982 A 6/1998
CN 1159675 C 7/2004

(Continued)

*Primary Examiner* — David B Bollinger
(74) *Attorney, Agent, or Firm* — Kilpatrick Townsend & Stockton LLP

(57) ABSTRACT

A banknote inclination correction device and an ATM (Automatic Teller Machine) including the banknote inclination correction device. The banknote inclination correction device includes: an inner channel board (008); an outer channel board (009); a banknote transfer channel formed between the inner channel board (008) and the outer channel board (009); a reference wall (008*a*) arranged on one side of the inner channel board (008) and the outer channel board (009); a transfer wheel (011) located at the inlet of the banknote transfer channel, and arranged on the inner channel board (008) or the outer channel board (009); multiple inclination correction wheel groups (014) configured on the inner channel board (008) or the outer channel board (009); and a transfer side wheel (019) located between the reference wall (008*a*) and the multiple inclination correction wheel groups (014), the transfer side wheel (019) is parallel to the reference wall. Each inclination correction wheel group (014) includes at least one inclination correction wheel, and the inclination correction wheel is inclined towards the reference wall (008*a*). The edge line speed of the transfer side wheel (019) is larger than that of the inclination correction wheel of the inclination correction wheel groups (014). The multiple inclination correction wheels of the transfer side wheel (019) improve the effect of inclination correction, so that the banknote can reach a corrected state at a time, and various types of banknotes can be transferred continuously and at high speed.

18 Claims, 8 Drawing Sheets

(56) References Cited

U.S. PATENT DOCUMENTS

| | | | | | |
|---|---|---|---|---|---|
| 5,381,021 | A | | 1/1995 | Polidoro | |
| 5,564,544 | A | * | 10/1996 | Takemoto et al. | 194/206 |
| 5,657,983 | A | * | 8/1997 | Fisk | 271/251 |
| 6,042,110 | A | * | 3/2000 | Inage | 271/251 |
| 7,445,208 | B2 | * | 11/2008 | Onodera | 271/239 |
| 8,469,358 | B1 | * | 6/2013 | Wen | 271/250 |
| 2010/0102504 | A1 | * | 4/2010 | Yasumoto | 271/251 |

FOREIGN PATENT DOCUMENTS

| | | | |
|---|---|---|---|
| CN | 1990367 | A | 7/2007 |
| CN | 100545067 | C | 7/2007 |
| CN | 101279680 | A | 10/2008 |
| CN | 102171119 | A | 8/2011 |
| CN | 201941273 | U | 8/2011 |
| JP | 2000296947 | A | 10/2000 |

* cited by examiner

BANKNOTE INCLINATION CORRECTION DEVICE AND ATM

This application is the US national phase of International Application No. PCT/CN2012/078165 filed on Jul. 4, 2012, which claims the priority of the Chinese Patent Application No. 201110288382.9, entitled "BANKNOTE INCLINATION CORRECTION DEVICE AND ATM", filed with the Chinese Patent Office on Sep. 23, 2011, which is herein incorporated by reference in its entirety.

FIELD OF THE INVENTION

The present invention relates to the technical field of paper correction, and in more to particular, to a correcting device for banknotes. The present invention also provides an automatic teller machine with the above correcting device for banknotes.

BACKGROUND OF THE INVENTION

In a deposit process via an ATM (abbreviation for the Automatic Teller Machine), banknotes are put often on the skew into a deposit opening of the ATM by a user. Therefore, the banknotes need to be corrected by a correcting device before entering into the inside of the ATM.

FIGS. 1 and 2 show an existing correcting device for banknotes with a cyclic correcting design. The process of correcting a skew banknote by the correcting device for banknotes is described as follows. After entering into the correcting device for banknotes, a banknote is transmitted to a correcting wheel 001 by a transmission wheel 007, and in a banknote transmission passage 003 the banknote is subjected to a component force F', parallel to the banknote transmission passage 003 and a component force $F'_b$ perpendicular to the banknote transmission passage 003 imparted from the correcting wheel 001. Under the action of the component force $F'_a$, the banknote is transmitted forward in the banknote transmission passage 003; meanwhile, under the action of the component force $F'_b$, the banknote is aligned toward a reference wall 004. Thus, the banknote is transmitted forward in the banknote transmission passage 003 while being aligned by taking the reference wall 004 as a reference. A sensor 005 is used for detecting the obliquity of the banknote. If the obliquity of the banknote does not meet a requirement, the banknote may enter again into the correcting device for banknotes under the guiding of a reversing block 006. The above process is repeated until the obliquity of the banknote meets the requirement. Then, the reversing block 006 is activated to change the direction of the passage, so that the banknote is transmitted out of the correcting device. Thus, the correcting process is completed.

The existing correcting device for banknotes adopts correcting wheels 001 singly arranged in three rows, and driven pressure wheels 002 corresponding to the correcting wheels 001. Such a design aims to avoid the occurrence of banknote jam in the banknote transmission passage 003 as a forward corner of the banknote comes into contact with the reference wall 004 due to an excessive component force $F'_b$ or a long-time action of the correcting wheel 001. However, this design has the following disadvantages. When a small-dimension banknote (i.e. a banknote with both a small length and a small width) is transmitted longitudinally, the banknote moves to the reference wall 004 by a relatively long distance due to the small width of the small-dimension banknote itself, and the correcting wheel 001 acts on the banknote for a shortened time because of the small length of the small-dimension banknote. For the above two reasons, the small-dimension banknote may not be able to move to the reference wall 004. Although the cyclic correcting design used in the existing correcting device for banknotes can overcome this problem, the next banknote can enter into the correcting device only after a previous banknote has been corrected and left the correcting device based on the cyclic correcting design, resulting in the discontinuousness of banknote transmission. The discontinuousness of banknote transmission will affect the working efficiency of the ATM, and then a functional requirement of transmitting banknotes at a high velocity continuously cannot be satisfied.

In sum, how to provide a correcting device for transmitting various-dimension banknotes at a high velocity continuously is a problem to be overcome presently by the skilled in the art.

SUMMARY OF THE INVENTION

In view of this, the present invention provides a correcting device for banknotes which can transmit various-dimension banknotes at a high velocity continuously.

In order to achieve the above object, the invention provides technical solutions as follows.

A correcting device for banknotes includes:

an inner passage plate and an outer passage plate, wherein a banknote transmission passage is formed between the inner passage plate and the outer passage plate;

a reference wall disposed on one side of the inner passage plate and the outer passage plate;

a transmission wheel located at the entrance of the banknote transmission passage and disposed on one of the inner passage plate and the outer passage plate;

a plurality of correcting wheel sets disposed on one of the inner passage plate and the outer passage plate, wherein each of the plurality of correcting wheel sets includes at least one correcting wheel oriented toward the reference wall; and a transmission side wheel located between the reference wall and the plurality of correcting wheel sets, the transmission side wheel being parallel to the reference wall, wherein the rim linear velocity of the transmission side wheel is greater than the rim linear velocity of the at least one correcting wheel in each of the plurality of correcting wheel sets.

Preferably, in the above correcting device for banknotes, both the inner passage plate and the outer passage plate are an arc with a radian less than 360° in shape.

Preferably, the above correcting device for banknotes further includes a transmission floating pressure wheel mounted on the other one of the inner passage plate and the outer passage plate opposite to the transmission wheel, wherein the transmission floating pressure wheel is disposed such as to be in rolling contact with the transmission wheel.

Preferably, the above correcting device for banknotes further includes a correcting floating pressure wheel mounted on the other one of the inner passage plate and the outer passage plate opposite to the at least one correcting wheel in each of the plurality of correcting wheel sets, wherein the correcting floating pressure wheel is disposed such as to be rolling contact with the at least one correcting wheel in each of the plurality of the correcting wheel sets.

Preferably, the above correcting device for banknotes further includes the transmission floating pressure wheel, and the transmission side wheel is polygonal in shape.

Preferably, the above correcting device for banknotes further includes the transmission floating pressure wheel. The correcting wheel sets are four in number, and are disposed successively from the entrance of the banknote transmission passage and then away from the entrance.

Preferably, the above correcting device for banknotes further includes the transmission floating pressure wheel, and the correcting wheel set close to the transmission wheel includes two or more correcting wheels.

Preferably, the above correcting device for banknotes further includes the transmission floating pressure wheel, and multiple transmission wheels are provided on a drive shaft perpendicular to a banknote transmission direction such as to be spaced equidistantly with each other along the drive shaft.

Preferably, the above correcting device for banknotes further includes the transmission floating pressure wheel, and the transmission wheel is threaded such as to drive a banknote to move away from the reference wall.

Based on the above correcting device for banknotes, the present invention further provides an automatic teller machine including the correcting device for banknotes described above.

In the correcting device for banknotes according to the present invention, during the operation, the rim linear velocity of the transmission side wheel is greater than the rim linear velocity of the correcting wheel of the correcting wheel sets. Under the action of the transmission side wheel, the side of the banknote close to the transmission side wheel moves faster than the other side of the banknote close to the correcting wheel. The deflection of the banknote is achieved due to the velocity difference between the two sides of the banknote, so as to correct a banknote more efficiently and to more effectively prevent a forward corner, which is close to the correcting wheel, of the banknote from colliding with the reference wall to otherwise cause the banknote jamming or blocking phenomenon. Moreover, multiple correcting wheel sets are employed in the correcting device for banknotes, and each of the correcting wheel sets includes at least one correcting wheel. The multiple correcting wheels can increase the transverse component force of the correcting device perpendicular to the banknote transmission passages, so that a small-dimension banknote can reach the reference wall under the action of the transverse component force. Accordingly, the correcting device for banknotes according to the present invention improves the correcting effect, thereby increasing the probability of correcting banknotes in one cycle, and the probability of correcting various-dimension banknotes. Therefore, the correcting device for banknotes according to the present invention can transmit various-dimension banknotes continuously at a high velocity.

BRIEF DESCRIPTION OF THE DRAWINGS

In order to more clearly illustrate the embodiments of the invention or the technical solutions of the prior art, drawings needed to be used in the description of the embodiments or the prior art will be introduced briefly as follows. It is obvious that the drawings described below are only some embodiments of the invention, and other drawings can be occurred to those skilled in the art based on these drawings without any creative effort.

REFERENCE NUMERALS IN FIGS. 3 TO 11

008 Inner Passage Plate,
009 Outer Passage Plate,
010 drive shaft,
011 transmission wheel,
012 belt pulley,
013 transmission floating pressure wheel,
014 transmission wheel set,
014*a* first correcting wheel set,
014*b* second correcting wheel set,
014*c* third correcting wheel set,
014*d* fourth correcting wheel set,
015 pulley,
016 gear,
017 rotating shaft,
018 transmission pulley,
019 transmission side wheel,
020 correcting floating pressure wheel,
021 banknote separating roller,
022 transmission device,
023 passage wheel.

DETAILED DESCRIPTION OF THE INVENTION

An object of the present invention is to disclose a correcting device for banknotes for transmitting continuously various-dimension banknotes at a high velocity. Another object of the present invention is to disclose an automatic teller machine with the correcting device.

The technical solutions in the embodiments of the present invention will be described clearly and completely in conjunction with the accompanying drawings in the embodiments of the present invention as follows. It is apparent that the described embodiments are only a part of and not all the embodiments of the present invention. All the other embodiments occurred by the skilled in the art based on the embodiments in the present invention without any creative effort fall within the scope of protection of the present invention.

Figure 1:
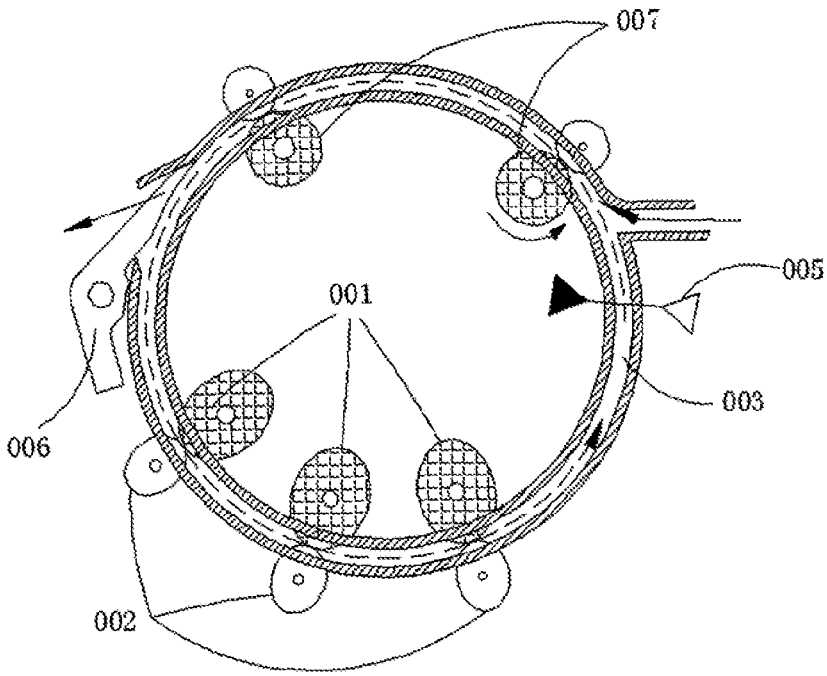
FIG. 1 is a front view of an existing correcting device.
Figure 2:
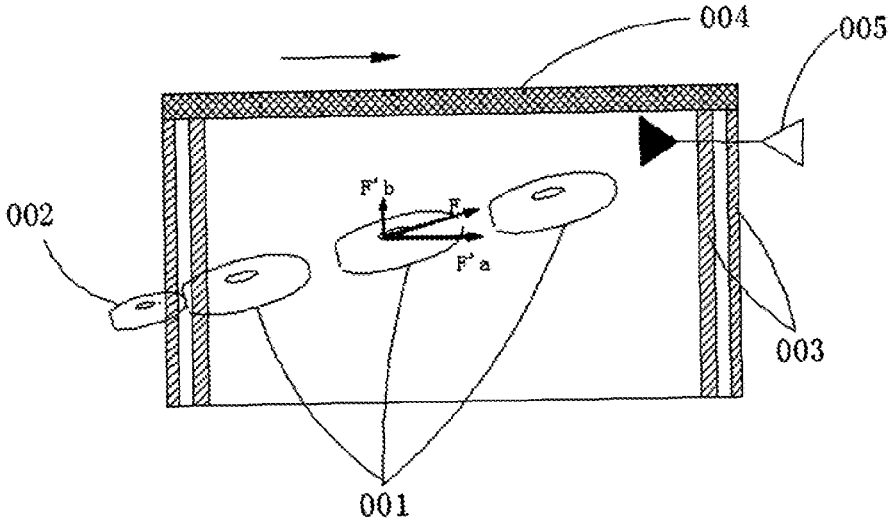
FIG. 2 is a top sectional view of an existing correcting device.
Figure 3:
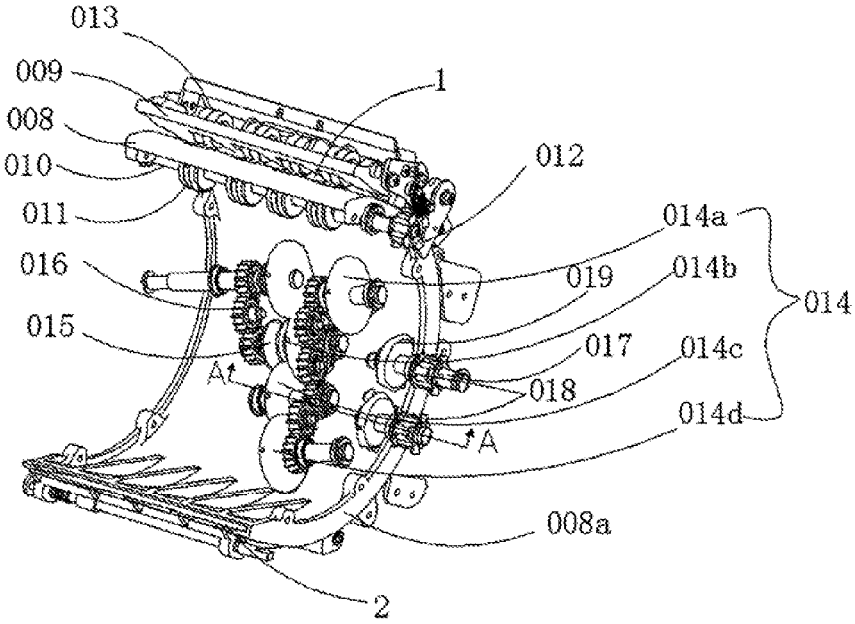
FIG. 3 is a front view of a correcting device for banknotes according to an embodiment of the present invention.
Figure 4:
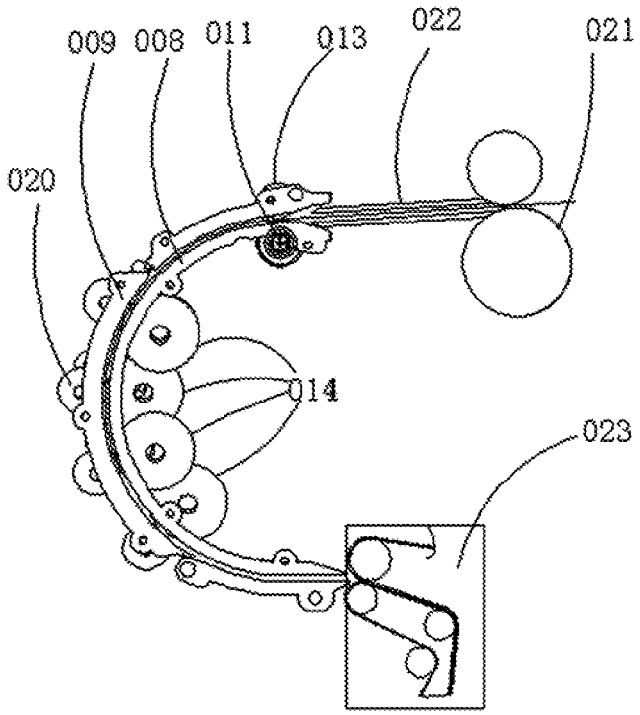
FIG. 4 is a side view of a correcting device for banknotes according to an embodiment of the present invention.

Reference is made to FIGS. 3 and 4. FIG. 3 is a front view of a correcting device for banknotes according to an embodiment of the present invention, and FIG. 4 is a side view of the correcting device for banknotes according to an embodiment of the present invention.

The embodiment of the present invention discloses a correcting device for banknotes including an inner passage plate 008, an outer passage plate 009, a reference wall 008*a*, a transmission wheel 011, a correcting wheel set 014 and a transmission side wheel 019.

A banknote transmission passage, in which a banknote is transmitted, is formed between the inner passage plate 008 and the outer passage plate 009.

The reference wall 008*a* is disposed on one side of the inner passage plate 008 and the outer passage plate 009. The banknote is aligned by taking the reference wall 008*a* as a reference while it is conveyed forward in the banknote transmission passage. The correcting device for banknotes according to the embodiment of the present invention corrects a skew banknote depending on the reference wall 008*a* as a reference. Specifically, the alignment of a banknote is achieved by lining up one side edge of the banknote against the reference wall 008*a*. Therefore, the banknote must be fully moved to the reference wall 008*a*.

The transmission wheel 011 is located at the entrance 1 of the banknote transmission passage, and is disposed on the inner passage plate 008 or the outer passage plate 009. Multiple correcting wheel sets 014 are disposed on the inner passage plate 008 or the outer passage plate 009. Each correcting wheel set includes at least one correcting wheel oriented toward the reference wall 008*a*. The correcting wheels in respective correcting wheel sets 014 are mounted such as to be directed toward the reference wall 008*a* at the same installation angle θ. The installation angle θ is an angle between the plane on which the correcting wheel is located and the plane on which the reference wall 008*a* is located. In this way, the banknote is allowed to move toward the reference wall 008*a*. The installation angle θ of the correcting wheel and the design rule of the correcting device are determined depending on the minimum-dimension banknote.

The installation angle θ of the correcting wheel in the correcting wheel sets 014 can be calculated by the following formulas:

$$V_a = V * \sin\theta \quad (1)$$

$$V_1 = V * \cos\theta \quad (2)$$

$$S/V_1 = L/V_a \quad (3)$$

$$L = W_1 - W_2 \quad (4)$$

It can be derived from formulas (1), (2), (3) and (4) that: $\theta = \mathrm{TAN}^{-1}[(W_1 - W_2)/S]$.

In these formulas, $V_a$ is the component velocity of a banknote; $V_1$ is the transmission velocity of a banknote in the banknote transmission passage; V is the transmission velocity of a correcting wheel in a correcting wheel set 014; S is the length of a banknote in a banknote transmission direction from the transmission wheel 011 to the passage wheel 023 in the correcting device; L is the distance by which a banknote moves in the direction perpendicular to the banknote transmission passage in the correcting device; $W_1$ is the width dimension of the correcting device; and $W_2$ is the width of a minimum-dimension banknote.

The installation angle θ of the correcting wheel must be determined such as to ensure that the minimum-dimension banknote (having a minimum width) moves to the reference side within a time T from the side of the correcting device opposite to the reference side. The time T is the time that a banknote passes through the correcting device at a component velocity $V_1$ in a direction perpendicular to the banknote transmission passage.

The transmission side wheel 019 is located between the reference wall 008*a* and the correcting wheel sets 014, and is installed at one end of a rotating shaft 017. At the other end of the rotating shaft 017 a transmission pulley 018 is provided to supply with power to the rotating shaft 017. The transmission side wheel 019 is parallel to the reference wall 008*a*, and has a rim linear velocity greater than that of the correcting wheel of the correcting wheel sets 014. In the case that banknote is wrinkled or turned up and thus cannot be transmitted forward, since the rim linear velocity of the transmission side wheel 019 is faster than that of the correcting wheel of the correcting wheel sets 014, the transmission velocities on both sides of banknotes are not the same. That is, the transmission velocity of the side of the banknote at the transmission side wheel 019 is faster than that of the other side of the banknote at the correcting wheel sets 014, so that the banknote may be deflected away from the reference wall 008*a*. When the side edge of the banknote near the reference wall 008*a* is deflected to lean against the reference wall 008*a*, and thus is blocked by the reference wall 008*a*. At this time, even under the action of the transmission side wheel 019, the banknote will not be deflected so as to achieve a correcting effect.

In the correcting device for banknotes according to the present invention, during the operation, the rim linear velocity of the transmission side wheel is greater than the rim linear velocity of the correcting wheel of the correcting wheel sets. Under the action of the transmission side wheel, the side of the banknote close to the transmission side wheel moves faster than the other side of the banknote close to the correcting wheel. The deflection of the banknote is achieved due to the velocity difference between the two sides of the banknote, so as to correct a banknote more efficiently and to more effectively prevent a forward corner, which is close to the correcting wheel, of the banknote from colliding with the reference wall to otherwise cause the banknote jamming or blocking phenomenon. Moreover, multiple correcting wheel sets are employed in the correcting device for banknotes, and each of the correcting wheel sets includes at least one correcting wheel. The multiple correcting wheels can increase the transverse component force of the correcting device perpendicular to the banknote transmission passages, so that a small-dimension banknote can reach the reference wall under the action of the transverse component force. Accordingly, the correcting device for banknotes according to the present invention improves the correcting effect, thereby increasing the probability of correcting banknotes in one cycle, and the probability of correcting various-dimension banknotes. Therefore, the correcting device for banknotes according to the present invention can transmit various-dimension banknotes continuously at a high velocity.

To further optimize the above technical effect, as shown in FIG. 4, both the inner passage plate 008 and the outer passage plate 009 are of an arc shape with a radian less than 360°. The existing correcting device for banknotes is of a closed circular shape, and operates in a cyclic correcting process in which, only after a previous banknote has been corrected and moved away from the correcting device, the next banknote can enter into the correcting device. In the correcting device according to the present invention, the various-dimension banknotes can be aligned to the reference wall 008*a* to achieve the correction in one cycle, without the need of adopting the banknote cyclic correcting process. Therefore, the device of the present invention is designed such as to be in an arc shape with a radian less than 360°.

The correcting device for banknotes according to the invention further includes a transmission floating pressure wheel 013. The transmission floating pressure wheel 013 is mounted on the inner passage plate 008 or the outer passage plate 009 opposite to the transmission wheel 011, and is disposed in rolling contact with the transmission wheel 011. The correcting device for banknotes further includes a correcting floating pressure wheel 020. The correcting floating pressure wheel 020 is mounted on the inner passage plate 008 or the outer passage plate 009 opposite to the correcting wheel, and is disposed in rolling contact with the correcting wheel of the correcting wheel set 014. If the transmission wheel 011 is installed on the inner passage plate 008, there is a need for a certain space in the inside of the inner passage plate 008 to accommodate a power source and associated transmission structures; accordingly, a transmission floating pressure wheel 013 is installed on the outer passage plate 009 opposite to the inner passage plate 008. In an alternative way, if the transmission wheel 011 is installed on the outer passage plate 009, there is a need for a certain space in the inside of the outer passage plate 009 to accommodate a power source and associated transmission structures; accordingly, the transmission floating pressure wheel 013 is installed on the inner passage plate 008 opposite to the outer passage plate 009. Under the tension action of the spring force, the transmission floating pressure wheel 013 always is in rolling contact with the transmission wheel 011, and presses banknotes to transmit the banknotes. Similarly, the correcting floating pressure wheel 020 is installed and transmits banknotes in the same processes as that of the transmission floating pressure wheel 013, which will not be repeatedly described herein.

Figure 5:
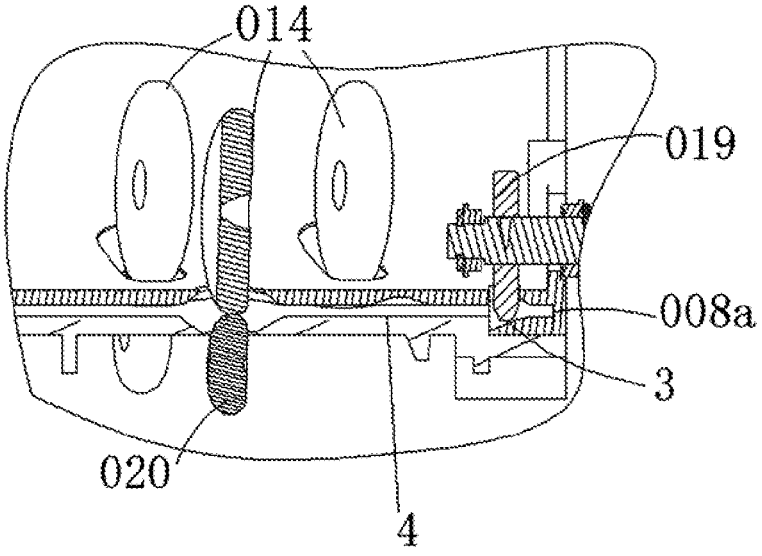
FIG. 5 is a sectional view taken along line A-A in FIG. 3 according to the embodiment of the present invention, showing a working state where a transmission side wheel presses a banknote so as to impart a force to the banknote.
Figure 6:
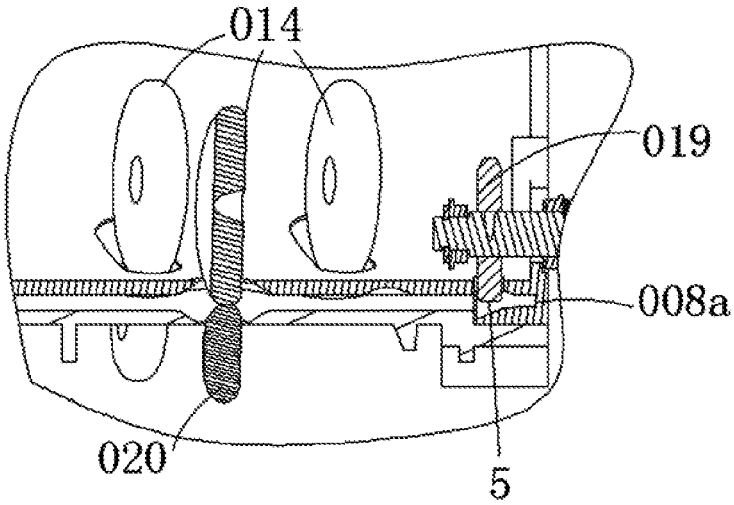
FIG. 6 is a sectional view taken along line A-A in FIG. 3 according to the embodiment of the present invention, showing a working state where the transmission side wheel keeps away from the banknote so as to allow the banknote to be aligned to a reference wall successfully.
Figure 7:
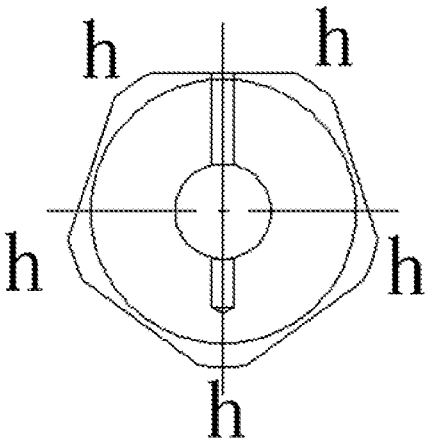
FIG. 7 is an outline view of a transmission side wheel according to an embodiment of the present invention.

The transmission side wheel 019 of the correcting device for banknotes according to the invention is polygonal in shape. Referring to FIGS. 5 to 7, FIG. 5 is a sectional view taken along line A-A in FIG. 3 according to an embodiment of the invention, showing a working state where the transmission side wheel presses a banknote so as to impart a force on the banknote; FIG. 6 is a sectional view taken along line A-A in FIG. 3 according to an embodiment of the invention, showing a working state where the transmission side wheel keeps away from a banknote so as to allow the banknote to be aligned against a reference wall successfully; and FIG. 7 is an outline view of a transmission side wheel according to an embodiment of the present invention.

Considering that the banknote must pass through the transmission side wheel 019 before moving to the reference wall 008*a*, the transmission side wheel 019 in the present invention is designed to be polygonal in shape. Referring to FIG. 5, when the transmission side wheel 019 is in contact with the banknotes, the arc face 3 at the maximum diameter of the transmission side wheel 019 is lower than the arc face 4 of the inside passage of the outer passage plate 009. The transmission side wheel 019 applies a resistance force to the banknote moving towards the reference wall 008*a* while pressing the banknote downwards, so that the banknote no longer moves towards the reference wall 008*a*. Referring to FIG. 6, after the arc face 3 at the maximum diameter of the transmission side wheel 019 moves away from the banknote, there is a certain gap between a side 5 of the polygonal transmission side wheel 019 and the banknote, that is, the transmission side wheel 019 may not contact with the banknote. Thus, the transmission side wheel 019 no longer prevents the banknote from aligning to the reference wall 008*a*. In this way, the transmission side wheel 019 can not only apply transmission force in transmission direction to the banknote, but also enable the banknote to move toward the reference wall 008*a*. Referring to FIG. 7, the transmission side wheel 019 is pentagonal in shape, but the design of the transmission side wheel 019 is not limited to the pentagonal shape. The transmission side wheel 019 can be made of rubber materials to increase the friction force between the transmission side wheel 019 and the banknote, and to improve the efficiency of the device transmitting banknotes.

Referring to FIG. 3, the correcting wheel sets 014 of the correcting device for banknotes according to the present invention are four in number, and are disposed successively from the entrance of the banknote transmission passage in a direction away from the entrance. The number of the correcting wheels in the correcting wheel set 014 close to the transmission wheel 011 is two or more. The correcting wheel sets 014 are located in middle of the banknote transmission passage, and are four in number, i.e. a first correcting wheel set 014*a*, a second correcting wheel set 014*b*, a third correcting wheel set 014*c* and a fourth correcting wheel set 014*d*. The correcting wheel set close to the transmission wheel 011, i.e. the first correcting wheel set 014*a*, includes two or more correcting wheels. After the power is transmitted to the second correcting wheel set 014*b* through a pulley 015, the second correcting wheel set 014*b* in turn transmits the power to the subsequent correcting wheel sets through a gear 016 so as to ensure that the correcting wheels rotate in the same direction at the same velocity. It should be noted that one correcting wheel may be included in the correcting wheel set close to the transmission wheel 011. However, in the case that the correcting wheel set close to the transmission wheel 011 is configured with only one correcting wheel, the banknote may be deflected greatly about a holding point under the holding action of single correcting wheel so that the banknote can not be efficiently corrected. Therefore, two or more correcting wheels are preferably provided in the first correcting wheel set 014*a* close to the transmission wheel 011. This configuration can ensure that multiple correcting wheels synchronously act on the banknote when the various-dimension banknote enters into the correcting wheel sets 014 to be hold, so as to prevent the excessive deflection of the banknote which would be caused by the single correcting wheel acting on the banknote, thereby enabling the banknote to be effectively corrected and then depart from the exit 2 of the correcting device.

Under the action of the multiple correcting wheels, a force Fa perpendicular to the banknote transmission passage to which the banknotes are subjected increases, ensuring that minimum-dimension banknotes can be aligned with the reference wall 008*a* in the correcting device, so as to correct banknotes in one cycle.

Referring to FIG. 3, there are multiple transmission wheels 011 in the correcting device for banknotes according to the present invention. The multiple transmission wheels 011 are disposed on a drive shaft 010 perpendicular to the transmission direction of the banknotes and are arranged and spaced with equal distance along the drive shaft 010. The transmission wheel 011 is provided with threads so as to drive the banknote to move away from the reference wall 008*a*. A wheel outer circumferential surface of the transmission wheel 011 is configured with a spiral flange with a certain helix lead angle. According to the spiral configuration direction of the transmission wheel 011, the banknote moves away from the reference wall 008*a*. Therefore, the transmission wheel 011 has a role of appropriate adjustment to the skew extent of the banknote. This adjustment not only can prevent in advance the banknote from being turned up by the forward corner of the banknote early contacting with the reference wall 008*a*, but also can facilitate subsequent movement of the banknote.

Preferably, the reference wall 008*a* and the inner passage plate 008 are designed into one-piece structure, so as to eliminate the jamming of the banknote resulting from a joint gap between the reference wall 008*a* and the inner passage plate 008.

The present invention discloses an automatic teller machine including a correcting device for banknotes as described above. The automatic teller machine according to the invention also has the technical effects mentioned above by adopting the above correcting device for banknotes, which will not be described herein.

In sum, the invention discloses a working process of a correcting device for banknotes.

Figure 8:
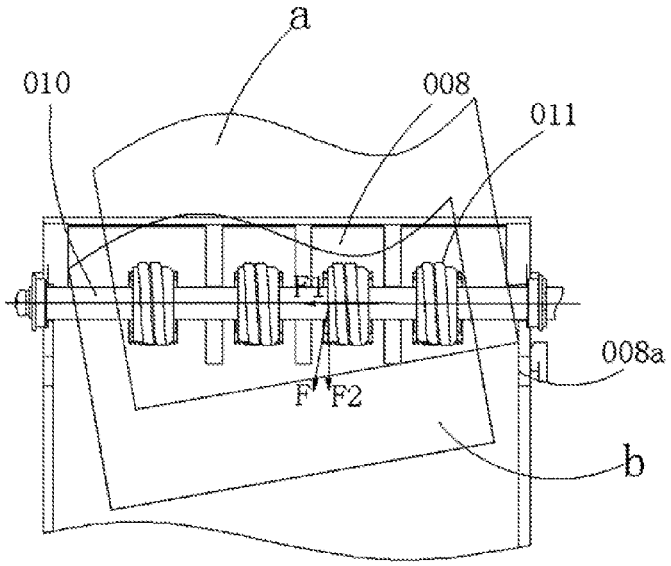
FIG. 8 shows configuration and features of a transmission wheel and a process of correcting a banknote state according to an embodiment of the present invention.
Figure 9:
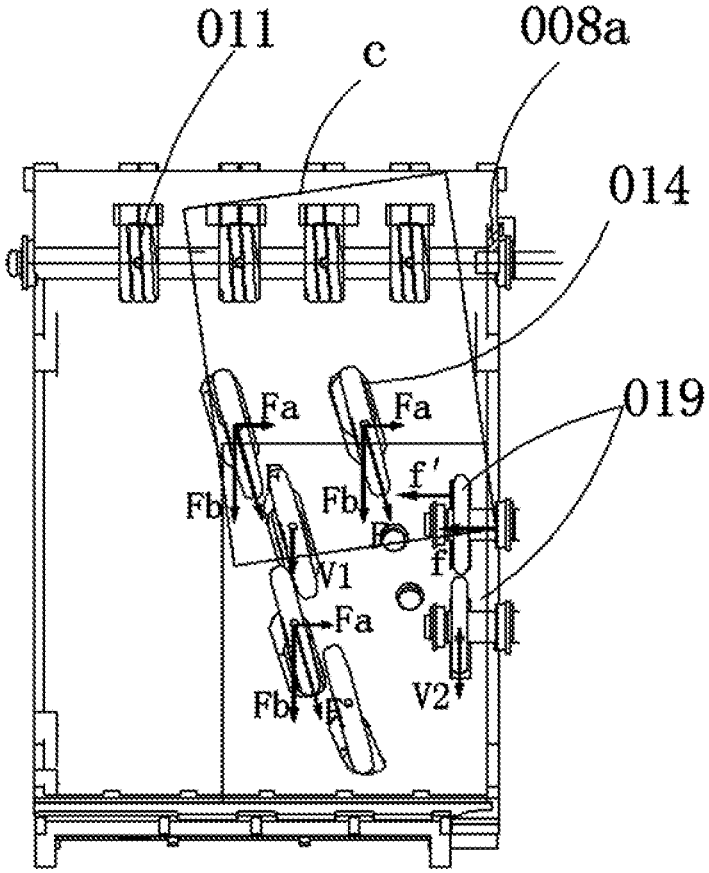
FIG. 9 shows a correcting process in the case where a banknote in a first state enters into the correcting device and a force analysis of the banknote during the correcting process according to an embodiment of the present invention.
Figure 10:
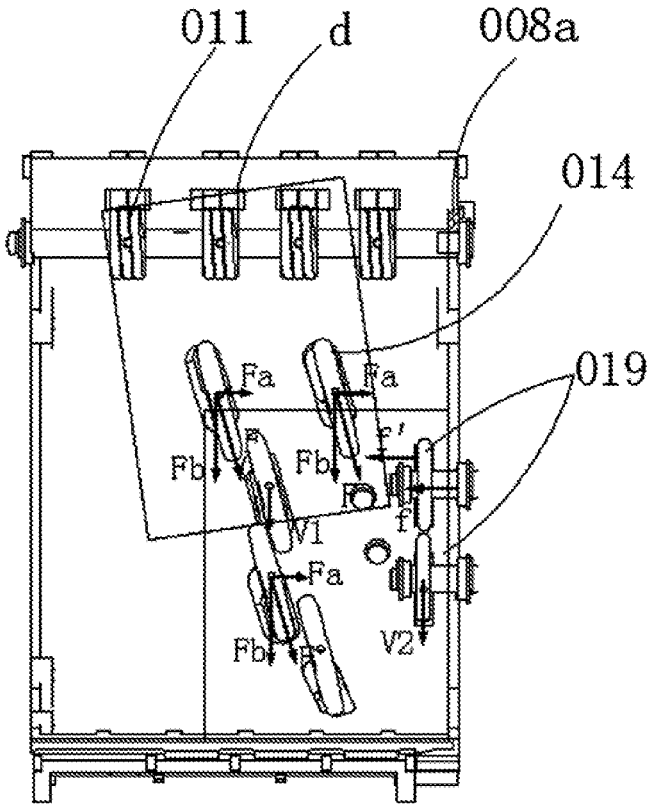
FIG. 10 shows a correcting process in the case where a banknote in a second state enters into the correcting device and a force analysis of the banknote during the correcting process according to an embodiment of the present invention.
Figure 11:
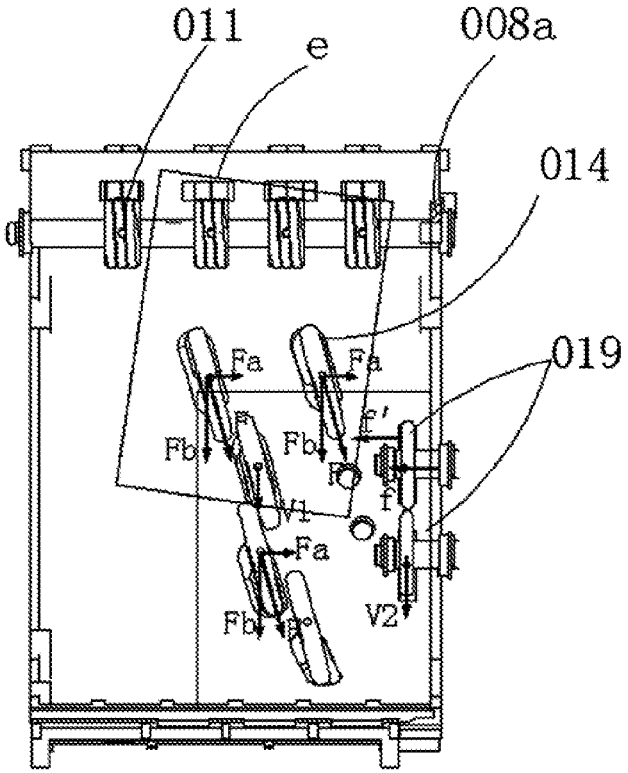
FIG. 11 shows a correcting process in the case where a banknote in a third state enters into the correcting device and a force analysis of the banknote during the correcting process according to an embodiment of the present invention.

Referring to FIGS. 4 and 8 to 11, FIG. 8 shows configuration and features of a transmission wheel and a process of correcting a banknote state according to an embodiment of the present invention; FIG. 9 shows a correcting process in the case where a banknote in a first state enters into the correcting device and a force analysis of the banknote during the correcting process according to an embodiment of the present invention; FIG. 10 shows a correcting process in the case where a banknote in a second state enters into the correcting device and a force analysis of the banknote during the correcting process according to an embodiment of the present invention; and FIG. 11 shows a correcting process in the case where a banknote in a third state enters into the correcting device and a force analysis of the banknote during the correcting process according to an embodiment of the present invention.

Referring to FIG. 4, after passing through the separating roller 021, the banknotes are continuously separated one after another, pass through the transmission device 022, and are arranged on the banknote transmission passage with the same intervals so as to enter into the correcting device. After entering the correcting device, the banknotes is clamped by a row of transmission wheels 011 disposed on the banknote transmission path at the entrance of the correcting device and the transmission floating pressure wheels 013 disposed on the other side of the passage corresponding to the transmission wheel 011. As shown in FIG. 8, the banknote moves away from the reference wall 008*a* under a force F1 of the transmission wheels 011 depending on the direction of configuration of the threads on the transmission wheels 011.

Referring to FIGS. 9, 10 and 11, a banknote in different form enters into the correcting wheel sets 014 of the correcting device. The following description is only made with reference to the limit positions illustrated in FIG. 9. FIGS. 10 and 11 show the banknote states where the banknote may be corrected by the existing correcting device, which will not be discussed particularly. After a banknote in a banknote state c shown in FIG. 9 enters into the correcting device, the spiral transmission wheel 011 at the entrance is unable to deflect a forward corner of the banknote away from the side wall. The banknote in a banknote state c shown in FIG. 9 enters into the correcting wheel sets 014 of the correcting device, and under a clamping component Fa of the correcting wheel sets 014, the banknote begins to be aligned with the reference. At this time, the banknote which has already been in contact with the reference wall is subjected to a resistance force f of the reference wall. The banknote continues to move toward the reference wall under a transverse component Fa of the correcting wheel 014. If the process goes on, the forward corner of the banknote is wrinkled or turned up in the case of insufficient rigidity, causing banknote jamming or blocking. The transmission side wheel 019 designed to be polygonal will press downwardly the side of the banknote close to the reference wall, which can loose the forward corner of the banknote contacting with the reference wall, with the resistance force f disappearing. Because the transmission side wheel 019 applies a resistance force f' to the banknote moving toward the reference wall 008*a* while pressing the banknote downwards, the banknote no longer moves toward the reference wall 008*a*. At this time, since the rim linear velocity of the transmission side wheel 019 is greater than the rim linear velocity of the correcting wheel, that is, V2>V1, the banknote can be deflected, so that the forward corner of the banknote will gradually move away from the reference wall 008*a*. After the forward corner of the banknote moves away from the reference wall 008*a*, the banknote is subject to the actions of the correcting wheel sets 014 and the transmission side wheel 019 at the same time. The rim linear velocity of the transmission side wheel 019 is greater than the rim linear velocity of the correcting wheel, resulting in the different transmission velocities at both sides of the banknote. In other words, the side of the banknote at the transmission side wheel 019 is transmitted at a greater velocity than the side of the banknote at the correcting wheel, that is, V2>V1, and thus the banknote may be deflected. The banknote leaves the correcting device after the side edge of the banknote is deflected to be aligned with the reference wall 008*a*.

The above description of the embodiments of the disclosure enables the skilled in the art to implement or use the present invention. Numerous modifications to these embodiments will be apparent for the skill in the art. The general principle defined herein can be applied to other embodiments without departing from the spirit or scope of the present invention. Therefore, the present invention will not be limited to these embodiments shown herein, but is to comply with the widest range coincident with the principle and novel characteristics of the disclosure.

What is claimed is:

1. A correcting device for banknotes, comprising:

an inner passage plate and an outer passage plate, wherein a banknote transmission passage is formed between the inner passage plate and the outer passage plate;

a reference wall disposed on one side of the inner passage plate and the outer passage plate;

a transmission wheel located at an entrance of the banknote transmission passage and disposed on one of the inner passage plate and the outer passage plate;

a plurality of correcting wheel sets disposed on one of the inner passage plate and the outer passage plate, wherein each of the plurality of correcting wheel sets comprises at least one correcting wheel oriented toward the reference wall; and a transmission side wheel located between the reference wall and the plurality of correcting wheel sets, the transmission side wheel being parallel to the reference wall, wherein a rim linear velocity of the transmission side wheel is greater than a rim linear velocity of the at least one correcting wheel in each of the plurality of correcting wheel sets.

2. The correcting device for banknotes according to claim 1, wherein both the inner passage plate and the outer passage plate are an arc with a radian less than 360° in shape.

3. The correcting device for banknotes according to claim 1, wherein the correcting device for banknotes further comprises a transmission floating pressure wheel mounted on the other one of the inner passage plate and the outer passage plate opposite to the transmission wheel, wherein the transmission floating pressure wheel is disposed such as to be in rolling contact with the transmission wheel.

4. The correcting device for banknotes according to claim 1, wherein the correcting device for banknotes further comprises a correcting floating pressure wheel mounted on the other one of the inner passage plate and the outer passage plate opposite to the at least one correcting wheel in each of the plurality of correcting wheel sets, wherein the correcting floating pressure wheel is disposed such as to be rolling contact with the at least one correcting wheel in each of the plurality of correcting wheel sets.

5. The correcting device for banknotes according to claim 1, wherein the transmission side wheel is polygonal in shape.

6. The correcting device for banknotes according to claim 1, wherein the correcting wheel sets are four in number, and are disposed successively from the entrance of the banknote transmission passage and then away from the entrance.

7. The correcting device for banknotes according to claim 6, wherein the correcting wheel set close to the transmission wheel comprises two or more correcting wheels.

8. The correcting device for banknotes according to claim 1, wherein a plurality of transmission wheels are provided on a drive shaft perpendicular to a banknote transmission direction such as to be spaced equidistantly with each other along the drive shaft.

9. The correcting device for banknotes according to claim 1, wherein the transmission wheel is threaded such as to drive a banknote to move away from the reference wall.

10. An automatic teller machine, comprising the correcting device for banknotes according to claim 1.

11. The automatic teller machine according to claim 10, wherein both the inner passage plate and the outer passage plate are an arc with a radian less than 360° in shape.

12. The automatic teller machine according to claim 10, wherein the correcting device for banknotes further comprises a transmission floating pressure wheel mounted on the other one of the inner passage plate and the outer passage plate opposite to the transmission wheel, wherein the transmission floating pressure wheel is disposed such as to be in rolling contact with the transmission wheel.

13. The automatic teller machine according to claim 10, wherein the correcting device for banknotes further comprises a correcting floating pressure wheel mounted on the other one of the inner passage plate and the outer passage plate opposite to the at least one correcting wheel in each of the plurality of correcting wheel sets, wherein the correcting floating pressure wheel is disposed such as to be rolling contact with the at least one correcting wheel in each of the plurality of correcting wheel sets.

14. The automatic teller machine according to claim 10, wherein the transmission side wheel is polygonal in shape.

15. The automatic teller machine according to claim 10, wherein the correcting wheel sets are four in number, and are disposed successively from the entrance of the banknote transmission passage and then away from the entrance.

16. The automatic teller machine according to claim 15, wherein the correcting wheel set close to the transmission wheel comprises two or more correcting wheels.

17. The automatic teller machine according to claim 10, wherein a plurality of transmission wheels are provided on a drive shaft perpendicular to a banknote transmission direction such as to be spaced equidistantly with each other along the drive shaft.

18. The automatic teller machine according to claim 10, wherein the transmission wheel is threaded such as to drive a banknote to move away from the reference wall.

* * * * *